US006257567B1

(12) United States Patent
Hansmann et al.

(10) Patent No.: US 6,257,567 B1
(45) Date of Patent: Jul. 10, 2001

(54) CONVEYING DEVICE FOR BOOK BINDING MACHINES

(75) Inventors: Rolf Hansmann, Rahden; Dieter Nehring, Bad Oeynhausen, both of (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/339,367

(22) Filed: Jun. 24, 1999

(30) Foreign Application Priority Data

Jul. 1, 1998 (DE) ..... 198 29 433

(51) Int. Cl.[7] ..... B65H 33/04

(52) U.S. Cl. ..... 270/58.07; 198/836.3; 198/606; 198/626.5; 198/626.3; 414/789.7

(58) Field of Search ..... 270/58.07, 58.08; 198/836.3, 606, 626.3, 626.5, 626.6, 341.05, 341.07; 414/789.7, 789.9; 156/357, 358, 908

(56) References Cited

U.S. PATENT DOCUMENTS

| | | | | |
|---|---|---|---|---|
| 3,089,534 | * | 5/1963 | Schuler et al. | 156/357 |
| 3,629,043 | * | 12/1971 | Hoff | 156/358 |
| 3,915,290 | * | 10/1975 | Zuercher et al. | 198/626.6 |
| 4,064,987 | * | 12/1977 | Rowan | 198/626.6 X |
| 4,217,977 | * | 8/1980 | Tam | 198/341.07 |
| 4,502,586 | * | 3/1985 | Dusel et al. | 198/626.6 X |
| 4,507,078 | * | 3/1985 | Tam et al. | 198/341.05 X |

FOREIGN PATENT DOCUMENTS

| | | |
|---|---|---|
| PS 11 35 825 | 3/1963 | (DE) . |
| AS 11 50 021 | 6/1963 | (DE) . |
| 24 28 620 A1 | 1/1975 | (DE) . |
| 31 24 626 A1 | 9/1982 | (DE) . |
| 36 15 706 C2 | 1/1988 | (DE) . |
| 37 13 260 A1 | 11/1988 | (DE) . |
| 40 14 651 A1 | 11/1991 | (DE) . |
| 34 45 928 C 2 | 7/1995 | (DE) . |
| 44 39 728 A1 | 5/1996 | (DE) . |
| 01 05 954 B1 | 5/1986 | (EP) . |

OTHER PUBLICATIONS

German Search Report for German Application No. 198 29 433.6.

* cited by examiner

*Primary Examiner*—Christopher P. Ellis
*Assistant Examiner*—Patrick Mackey
(74) *Attorney, Agent, or Firm*—Alix, Yale & Ristas, LLP

(57) ABSTRACT

A conveying device for book binding machines having continous plate or cleated chains or similar conveying machanism. The conveying device includes oppositely disposed logitudinal guides which support the plate or pleated chains for clamping inner books or books therebetween. In a defined subsection of the conveying device, apparatus are provided for opening and closing the subsection for releasing and capturing the book or inner book. Such apparatus includes working cylinders which act on sections of the longitudinal guides, and thereby the plate or cleated chain, to increase or decrease the distance between the longitudinal guides in the subsection.

12 Claims, 2 Drawing Sheets

CONVEYING DEVICE FOR BOOK BINDING MACHINES

BACKGROUND OF THE INVENTION

This invention relates generally to conveying devices for book binding machines. More particularly, the present invention relates to conveying device for book binding machines having continuous plate or cleated chains or similar conveying means. Typically such conveying devices have oppositely disposed longitudinal guides on the conveying track for supporting the plate or cleated chains in the region where inner books or books are clamped therebetween.

In German Patent DE-OS 24 28 620 a plate conveying device for book binding machines is disclosed which comprises a continuous roller chain pair driven by chain wheels. Plates are supported in an articulated manner on the chain studs by means of plate holders. Longitudinal guides which are disposed opposite one another are used to support the plate chains in the clamping zone. The distance between the active plate chain runs, including the longitudinal guides, is adjustable in accordance with the inner book thickness so that the inner books may be firmly clamped and conveyed in a linear direction.

SUMMARY OF THE INVENTION

Briefly stated, the invention in a preferred form is a conveying device which facilitates the release of inner books or books from the conveying device for successive capture by processing stations of a book assembly line. For example the conveying device may release such a book for further processing operations after which the book is returned to the conveying device. Alternatively, an inner book may be released from the conveying device for inspection purposes.

The conveying device includes clamping means having oppositely disposed clamping surfaces for clamping the book or inner book therebetween. The clamping surfaces define a longitudinally extending clamping region having at least one defined subsection. The device also includes guide means slidably engaged with the clamping means for guiding the clamping means. The guide means includes oppositely disposed, longitudinal conveying guides. A control device opens and closes the subsection, where the distance between the clamping surfaces is increased and decreased, respectively, to release or capture the inner book or book, respectively.

The guide means further includes oppositely disposed longitudinal subsection guides which are separate from the conveying guides. The subsection guides are operable by the control device to move the clamping surfaces between a clamping position and an opening position. Oppositely disposed longitudinal transitional guides may be positioned intermediate the subsection guides and the conveying guides. The transitional guides are coupled to the conveying guides and subsection guides by connectors which are received in oval openings or longitudinally extending slots in the conveying guides and subsection guides.

Each of the oppositely disposed clamping surfaces may comprise a roller chain and a continuous plate or cleated chain. The roller chain has a plurality of elongated chain studs which are received in grooves in the conveying guides, subsection guides, and transitional guides.

It is an object of the invention to provide a new and improved conveying device for book binding machines.

It is also an object of the invention to provide a conveying device for book binding machines that releases and recaptures a book or an inner book at multiple processing stations of the book binding machine.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
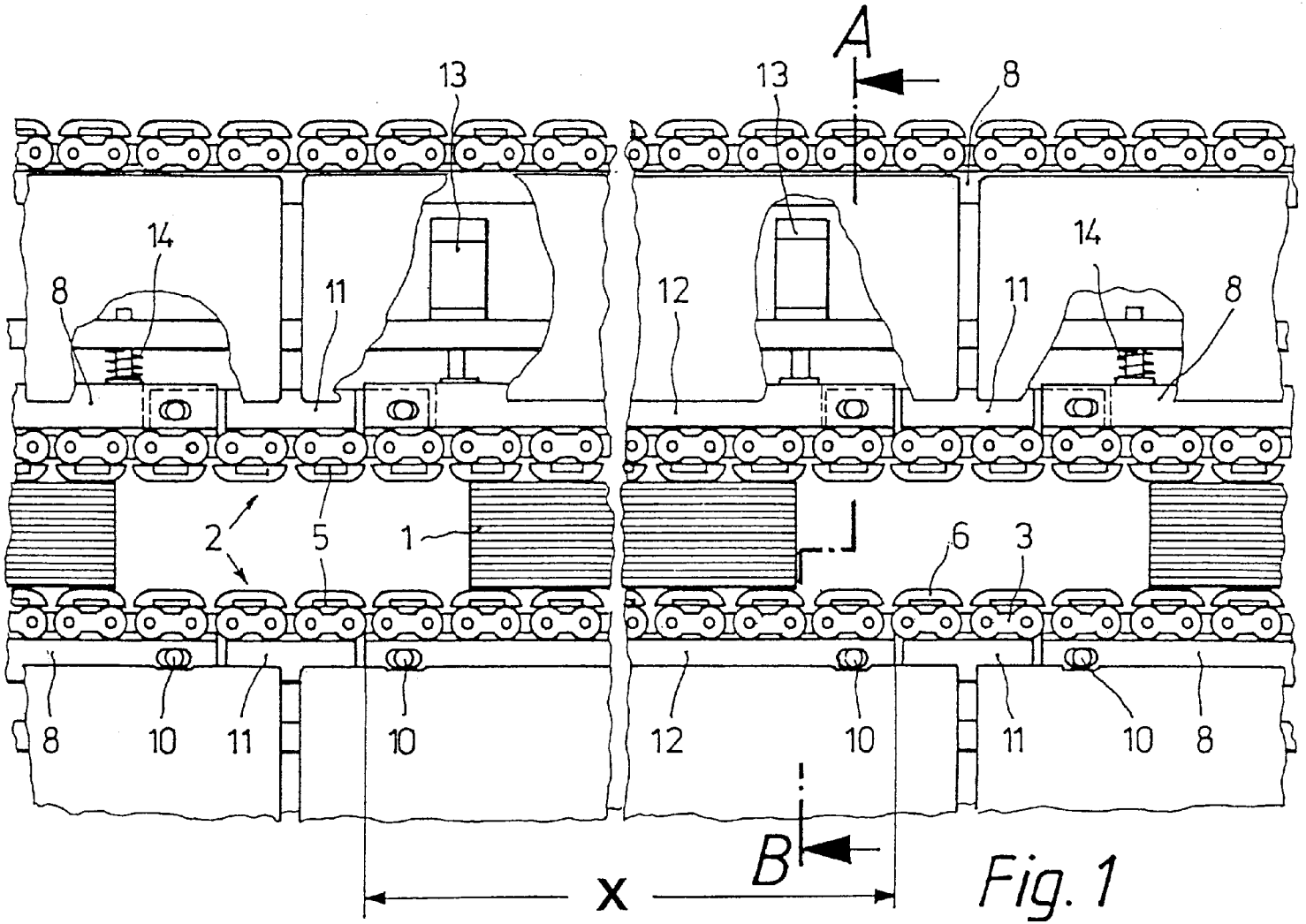
FIG. 1 is a plan view, partly broken away, of a conveying device according to the invention.

With reference to the drawings wherein like numerals represent like parts throughout the several figures, a conveying device in accordance with the present invention is used, for example, to convey inner books 1 at defined timing intervals through processing stations of a book assembly line. During conveying, the inner books 1 are held clamped by cooperating pairs of continuous cleated chains 2 and conveyed in a linear direction. The cleated chains 2 comprise roller chains 3, which are supported by springs 14 against longitudinal guides 8 and have resilient supports in the form of rubber cleats 6 fastened by brackets 5 to the chain links. The roller chains 3 have elongated chain studs 3*a,* which engage into grooves 9 of the longitudinal guides 8.

Figure 2:
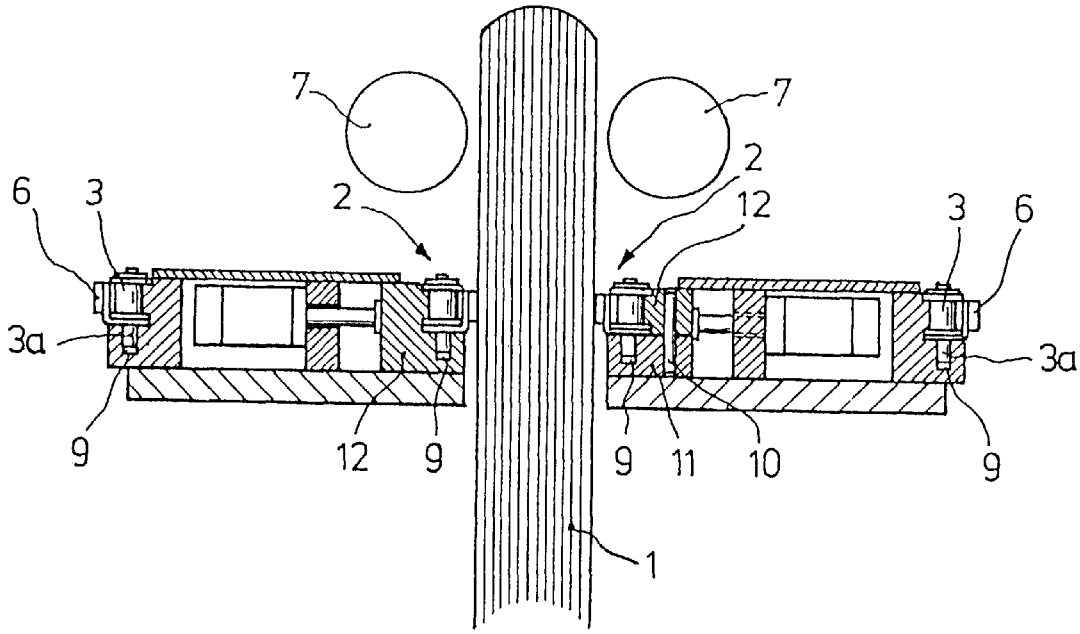
FIG. 2 is a cross-sectional view of the conveying device taken along line A–B of FIG. 1.

FIG. 2 illustrates a schematic view of a processing station for rounding the inner book spine. The processing station includes rounding rollers 7, which are disposed above the conveying device. The rollers 7 capture or take over the inner book 1 from the conveying device. After the inner book 1 is released from the conveying device, the rollers 7 effect a relative displacement of the printed sheets by rolling the inner book 1 under pressure through a defined angle of rotation. After rounding of the inner book spine has been effected, the conveying device takes over the inner book 1 from the rounding rollers 7.

To affect release of the inner books 1 in the individual processing stations (e.g. in the previously described spine rounding device) the distance between the active runs of the cleated chains 2 is variable in a defined sub-section "X" to provide an opening in the conveying device. For this purpose, longitudinal guides 12 are provided which are separate from the longitudinal guides 8. Longitudinal guides 12 extend over the length of the processing station and have grooves 9 which receive the elongated chain studs 3*a*. Working cylinders 13 act upon the end portions of the longitudinal guides 12 and hence the cleated chains 2 in the region "X" of the processing station. After the take-over of an inner book 1 by the rounding rollers 7, working cylinders 1 3 retract longitudinal guides 12 and the cleated chains 2 in the region "X" of the processing station out of the clamping position into an opening position. Upon completion of processing of the inner book 1, working cylinders 13 return longitudinal guides 12 and the cleated chains 2 in the region "X" of the processing station into their original setting in a clamping position.

To prevent the inner book 1, which is held clamped by the rubber cleats 6, from being damaged in the top and bottom edge region upon passing the points of separation (between the longitudinal guides 8 and the separate longitudinal guides 12), transitional longitudinal guides 11 are provided. The transitional longitudinal guides 11 are coupled in an articulated and positive manner by connectors 10 which are received in oblong slots in longitudinal guides 12 and 8. Transitional guides 11 also have grooves 9 for receiving the elongated chain studs 3*a*.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A conveying device for book binding machines defining a clamping region having at least one clamping subsection and at least one release subsection, the conveying device comprising:

oppositely disposed continuous plates or cleated chains extending longitudinally through the clamping region, the continuous plates or cleated chains defining a gap having a distance and being adapted for clamping inner books or books therebetween in the clamping region;

a pair of oppositely disposed fixed longitudinal guides disposed in each of the clamping subsections;

a pair of oppositely disposed moveable longitudinal guides disposed in each of the release subsections, the moveable longitudinal guides being separate from the fixed longitudinal guides; and control means for opening and closing each of the release subsections wherein the distance between the oppositely disposed continuous plate or cleated chains within the release subsection is increased and decreased, respectively, whereby the inner book or book is released and captured, respectively.

2. The conveying device of claim 1 wherein each continuous plate or cleated chain includes a roller chain having a plurality of elongated chain studs and the fixed longitudinal guides and the moveable longitudinal guides each define a groove for receiving the chain studs.

3. The conveying device of claim 2 further comprising at least one pair of oppositely disposed transitional longitudinal guides, a pair of transitional longitudinal guides being positioned between the fixed longitudinal guides of each clamping subsection and the moveable longitudinal guides of each release subsection.

4. The conveying device of claim 3 wherein each of the transitional longitudinal guides has grooves for receiving the elongated chain studs and is coupled in an articulated and positive manner by means of oblong hole connections with the adjacent fixed and moveable longitudinal guides.

5. A conveying device for book binding machines having at least one processing station, the conveying device comprising:

clamping means having oppositely disposed clamping surfaces for clamping a book or inner book therebetween, the clamping surfaces defining a longitudinally extending clamping region and a distance, the clamping region having at least one clamping subsection and at least one release subsection;

guide means slidably engaged with the clamping means for guiding the clamping means, the guide means including a plurality of longitudinal conveying guide sections, a pair of oppositely disposed, conveying guide sections being disposed in each of the subsections, the conveying guide sections disposed in the release subsection being separate from conveying guide sections disposed in the clamping subsection; and control means for opening and closing the release subsection wherein the distance between the clamping surfaces is increased and decreased, respectively, whereby the inner book or book is released and captured, respectively.

6. The conveying device of claim 5 wherein each of the oppositely disposed clamping surfaces comprises a roller chain and a continuous plate or cleated chain, the roller chain having a plurality of elongated chain studs, and each of conveying guide sections defines a groove for receiving the chain studs.

7. The conveying device of claim 5 wherein the conveying guide sections disposed in the release subsection are operable by the control means between a clamping position and an opening position.

8. The conveying device of claim 5 wherein each of the oppositely disposed clamping surfaces comprises a roller chain having a plurality of elongated chain studs, and each of of the conveying guide section defines a groove for receiving the chain studs.

9. The conveying device of claim 5 wherein the guide means further includes oppositely disposed longitudinal transitional guide sections positioned intermediate the conveying guide sections of the clamping and release subsections.

10. The conveying device of claim 9 wherein each of the oppositely disposed clamping surfaces comprises a roller chain having a plurality of elongated chain studs, and each of transitional guide sections defines a groove for receiving the chain studs.

11. The conveying device of claim 9 wherein each of the conveying guide sections defines a longitudinally extending slot and each of the oppositely disposed transitional guide sections include a pair of connectors, one of the connectors being received in a slot of a conveying guide section of a clamping subsection and one of the connectors being received in a slot of a conveying guide section of a release subsection.

12. The conveying device of claim 1 wherein the moveable longitudinal guides in each release subsection are operable by the control means for movement between a clamping position and an opening position.

* * * * *